US010961741B2

(12) United States Patent
Ling et al.

(10) Patent No.: US 10,961,741 B2
(45) Date of Patent: Mar. 30, 2021

(54) PORTABLE CONFINEMENT APPARATUS

(71) Applicant: HKD SOLUTIONS LTD, West Linton Peebleshire (GB)

(72) Inventors: Heather Ling, West Linton Peebleshire (GB); Derek Richardson, West Linton Peebleshire (GB); Scott Ling, West Linton Peebleshire (GB)

(73) Assignee: HKD Solutions Limited, West Linton (GB)

( * ) Notice: Subject to any disclaimer, the term of this patent is extended or adjusted under 35 U.S.C. 154(b) by 0 days.

(21) Appl. No.: 16/082,681

(22) PCT Filed: Mar. 6, 2017

(86) PCT No.: PCT/GB2017/050595
§ 371 (c)(1),
(2) Date: Sep. 6, 2018

(87) PCT Pub. No.: WO2017/153729
PCT Pub. Date: Sep. 14, 2017

(65) Prior Publication Data

US 2019/0099011 A1 Apr. 4, 2019

(30) Foreign Application Priority Data

Mar. 8, 2016 (GB) ..... 1604008
Sep. 8, 2016 (GB) ..... 1615292
Nov. 1, 2016 (GB) ..... 1618405

(51) Int. Cl.
*E04H 15/32* (2006.01)
*E04H 15/34* (2006.01)
(Continued)

(52) U.S. Cl.
CPC ..... *E04H 15/324* (2013.01); *A47C 21/08* (2013.01); *A47C 29/003* (2013.01);
(Continued)

(58) Field of Classification Search
CPC ..... E04H 15/34; E04H 15/56; E04H 15/324; E04H 15/36; E04H 15/54; A47C 29/003;
(Continued)

(56) References Cited

U.S. PATENT DOCUMENTS 2,641,776 A * 6/1953 Jensen ..... E04H 15/06 5/113
2,817,344 A * 12/1957 Teeter ..... E04H 15/52 135/129
(Continued)

OTHER PUBLICATIONS

International Search Report and Written Opinion in corresponding International Patent Application No. PCT/GB2017/050595, dated Jun. 6, 2017. 11 pages.
(Continued)

*Primary Examiner* — Robert Canfield
(74) *Attorney, Agent, or Firm* — Law Office of Jesse D. Lambert, LLC

(57) ABSTRACT

A portable confinement apparatus having an enclosure for confining a person upon a mattress. The enclosure is formed of a flexible material having a base face, at least four side faces and a roof which define a void, with a pocket for the mattress. A frame has four base members arranged in a rectangle with two bridge members, arranged over the base members. At least part of each base member is integrally secured to the base section and at least part of each bridge member is integrally secured to the roof section. The enclosure is provided with at least two closable openings on different sides. An opening may extend into the roof section. Support struts and a stabilisation system are also described to increase stability and prevent tipping. Members may be telescopic to increase the portability of the apparatus.

15 Claims, 5 Drawing Sheets

(51) Int. Cl.

| | |
|---|---|
| ***A47C 29/00*** | (2006.01) |
| ***E04H 15/36*** | (2006.01) |
| ***E04H 15/54*** | (2006.01) |
| ***A47D 7/00*** | (2006.01) |
| ***A47C 21/08*** | (2006.01) |
| ***A61G 7/05*** | (2006.01) |

(52) U.S. Cl.
CPC ..... *A47C 29/006* (2013.01); *A47D 7/002* (2013.01); *A61G 7/0526* (2013.01); *E04H 15/34* (2013.01); *E04H 15/36* (2013.01); *E04H 15/54* (2013.01)

(58) Field of Classification Search
CPC ..... A47C 17/64; A47C 17/70; A47C 21/08; A47C 29/006; A47D 7/00; A61G 7/0526
USPC ... 135/87, 96, 137, 148, 115, 116, 128, 130, 135/136, 138, 143, 153, 154; 52/63, 83, 52/79.5, 86; 5/112–114, 414–415, 424
See application file for complete search history.

(56) References Cited

U.S. PATENT DOCUMENTS 2,856,941 A * 10/1958 O'Neal ..... E04H 6/02 135/137
2,864,388 A * 12/1958 Oliver ..... E04H 15/38 135/133
2,960,993 A * 11/1960 Holmstrom ..... E04H 15/46 135/130
3,584,322 A * 6/1971 McDougall ..... A47C 29/006 5/113
3,601,825 A * 8/1971 Moorhead ..... A47C 29/003 5/110
3,703,181 A * 11/1972 Tholen ..... E04H 15/06 135/88.15
3,751,741 A * 8/1973 Hendry ..... A47G 9/086 5/413 AM
3,800,814 A * 4/1974 Hibbert ..... E04H 15/00 135/93
3,848,279 A * 11/1974 Ipsen, Jr. ..... A47C 17/70 5/113
3,896,831 A * 7/1975 Feldman ..... E04H 15/44 135/142
4,198,996 A * 4/1980 Keable ..... E04H 15/06 135/117
4,404,980 A * 9/1983 Wade ..... E04H 15/36 135/117
4,641,387 A * 2/1987 Bondy ..... A61G 7/0526 5/284
5,018,227 A * 5/1991 Canfield ..... A47C 17/70 5/111
5,072,694 A * 12/1991 Haynes ..... A01K 1/0353 119/28.5
5,240,021 A * 8/1993 Snodgrass ..... E04H 15/425 135/116
5,247,768 A * 9/1993 Russo ..... E04H 15/20 52/2.13
5,384,925 A * 1/1995 Vail ..... A47C 29/006 5/310
5,390,689 A * 2/1995 Graillat ..... E04H 15/48 135/126
5,544,864 A 8/1996 Gabriel-Lacki et al.
5,711,743 A * 1/1998 Nichols, Jr. ..... A63B 5/11 135/133
5,784,732 A * 7/1998 Vail ..... A47C 21/08 16/350
5,913,322 A * 6/1999 Gallant ..... E04H 15/42 135/124
6,073,282 A * 6/2000 Leeper ..... A47G 9/086 2/69.5
6,167,898 B1 * 1/2001 Larga ..... E04H 15/20 135/124
6,216,291 B1 * 4/2001 Eads ..... A61G 7/0526 135/121
6,354,317 B1 * 3/2002 Lah ..... E04H 15/425 135/118
6,687,930 B1 * 2/2004 Eads ..... A47C 29/003 135/121
6,866,009 B2 * 3/2005 Smith, Jr. ..... A01K 1/0254 119/840
7,921,863 B2 * 4/2011 Ways ..... E04H 15/34 135/125
8,776,812 B1 * 7/2014 Forget ..... E04H 15/56 135/116
9,485,957 B2 * 11/2016 Kellogg ..... A01K 1/034
9,669,184 B2 * 6/2017 Hill ..... A61M 21/0094
9,750,240 B2 * 9/2017 Parsons ..... A01M 31/025
10,306,995 B2 * 6/2019 Swanson ..... E04H 15/34
2004/0065361 A1 * 4/2004 Pratt ..... E04H 15/324 135/148
2004/0107984 A1 6/2004 Kline
2005/0103279 A1 5/2005 Brewer et al.
2005/0217026 A1 * 10/2005 Ramirez ..... A47D 13/066 5/93.1
2006/0266399 A1 * 11/2006 Ferrari ..... E04H 15/38 135/96
2007/0294827 A1 * 12/2007 Carr ..... A47C 21/00 5/600
2011/0048481 A1 3/2011 Morris et al.
2011/0309651 A1 * 12/2011 Hernandez ..... B60J 7/1621 296/100.08
2014/0318587 A1 * 10/2014 Anderson, Jr. ..... E04H 15/36 135/155

OTHER PUBLICATIONS

International Preliminary Report on Patentability in corresponding International Patent Application No. PCT/GB2017/050595, dated Sep. 11, 2018. 7 pages.

* cited by examiner

PORTABLE CONFINEMENT APPARATUS

CROSS-REFERENCE TO RELATED PATENT APPLICATIONS

This application is a U.S. National Stage Application under 35 U.S.C. § 371 of International Patent Application No. PCT/GB2017/050595, filed Mar. 6, 2017, which claims the benefit of priority under 35 U.S.C. Section 119(e) of British Patent Application numbers GB 1604008.1 filed Mar. 8, 2016; GB 1615292.8 filed Sep. 8, 2016; and GB 1618405.3 filed Nov. 1, 2016, all of which are incorporated by reference in their entireties. The International Application was published on Sep. 14, 2017, as International Publication No. WO 2017/153729 A1.

The invention relates to a portable confinement apparatus and, in particular, to a portable apparatus defining an enclosure for confining a person upon a mattress.

For many carers, ensuring the safety of a child or adult with a sleep issue, who is in their care, can be difficult. Ensuring the safety of the person as they rest, both by knowing their location and keeping them contained so that they cannot injure themselves on their surroundings can be challenging. Historically, systems involving straps for body restraint have been relied upon, but these have become less popular in recent times.

Development of confinement zones has become more popular with development of enclosures which restrict a person to the area of their bed. Such bed enclosures generally involve a supporting frame which is built over the whole bed with a covering which is fitted over the top. The covering is provided with access panels which can be opened and closed in order to provide access to the interior of the enclosure. These bed enclosures provide a safe but more humane and less restrictive environment for the person. However, as such bed enclosures are built around an existing bed, it can be problematic to move the bed enclosure after it is installed. They also, typically, cannot be collapsed and transported for temporary use on another bed, as would be required for visits and holidays.

U.S. Pat. No. 7,971,596 describes a portable confinement device which receives a mattress and has a confinement canopy supported by a frame. This arrangement is transportable. However, the arrangement of the frame and canopy are such that it can be difficult to access the interior of the device and the frame and canopy can move independently of one another causing inherent instability.

It is therefore an object of the present invention to provide a confinement apparatus which is portable and which offers improved accessibility.

It is a further object of the present invention to provide a confinement apparatus which offers increased stability.

According to a first aspect of the invention there is provided a portable confinement apparatus for confining a person upon a mattress, the apparatus comprising an enclosure formed of a flexible material adapted to receive a mattress, the enclosure having a base face, at least four side faces and a roof which define a void, and a frame formed of elongate resilient members, the frame having at least two base members arranged parallel to one another at a predetermined distance, at least two bridge members, arranged parallel to one another at a pre-determined distance, each bridge member having a first end and a second end such that each first end is coupled to a first base member and each second end is coupled to a second base member, wherein, at least part of each base member is integrally secured to the base section and at least part of each bridge member is integrally secured to the roof section and the enclosure is provided with at least two closable openings with a first closable opening formed on a first side and a second closable opening formed on a second side.

By integrally securing at least part of the base members and at least part of the bridge members to the enclosure, and by providing two openings to the enclosure, there is provided a mattress receiving portable confinement apparatus which is stable and robust whilst enabling easy access to the enclosure.

Preferably, the first closable opening is formed on a first side and the second closable opening is formed on a second side adjacent to the first side.

Provision of accessible openings on adjacent sides of the enclosure allows for ease of access to facilitate moving and handling of a person disposed in the enclosure void.

Optionally, the first closable opening is formed on a first side and the second closable opening formed on a second side opposite to the first side.

Provision of accessible openings on opposing sides of the enclosure allows for "straight-through" access to the enclosure void thus facilitating the ability to move and handle a person disposed in the enclosure void.

Preferably, the enclosure is provided with a third closable opening formed on a third side. Provision of a third opening enables significant access to the void of the enclosure facilitating the ability of a carer to move and handle someone within the void.

Preferably, the closable openings are adapted to extend from the at least one side section to at least a part of the roof section. The ability of the openings to open up the side and part of the roof allows increased access to the void facilitating the ability to move and handle a person disposed in the enclosure void.

Preferably, one closable opening is adapted to extend from the at least one side to a majority of the roof section. Such an extended closable opening added to the enclosure can provide ease of access to the void by a hoist.

Preferably the sides of the enclosure are substantially vertical. By providing substantially vertical sides the flexible material of the enclosure will not impinge upon the head space of a person lying on the mattress of the apparatus.

Preferably the enclosure is provided with a closable pocket disposed adjacent the base face, wherein the pocket is adapted to receive a mattress. By arranging a closable mattress receiving pocket below the base face of the enclosure, a mattress can be received within the enclosure to provide a person with a comfortable base on which to lie upon.

The pocket may be provided with a first zipper to enable closable opening of the pocket to receive a mattress. The pocket may be provided with a second zipper to adjust to size of the pocket. Provision of a second zipper to adjust the size of the pocket can allow the pocket to be adjusted to receive mattresses of different sizes therefore ensuring the mattress fits snugly within the pocket thus removing strain on the pocket or the ability of the mattress to move freely within the pocket thus decreasing stability of the apparatus.

Preferably, one or more of the resilient members are telescopic. In this way, the members can be collapsed for transportation.

Preferably the frame includes one or more support struts, each support strut being used to brace a bridge member to a base member. Preferably there are two support struts for each bridge member. In this way, is a user pulls on a bridge member they are unlikely to be able to collapse the apparatus. The one or more support struts may include pistons. In this way, leverage applied to the bridge members will cause controlled collapsing of the struts and their automatic resetting when released. This prevents damage to the frame if the bridge members are pulled. More preferably the support struts include pneumatic gas pistons giving telescopic movement and automatic resetting.

The apparatus may include a stabilisation system to increase a footprint of the frame. By increasing the footprint of the frame the stabilisation system prevents tipping of the apparatus. Preferably the stabilisation system comprises one or more stabilisation struts which are connected to and located outside the frame. The stabilisation system may include one or more base plates which are arranged to lie parallel to and outside the frame. Such base plates spread the load if the apparatus is tipped and thereby prevent tipping thereof.

An embodiment of the present invention will now be described with reference to the following figures, by way of example only, in which.

Figure 6:
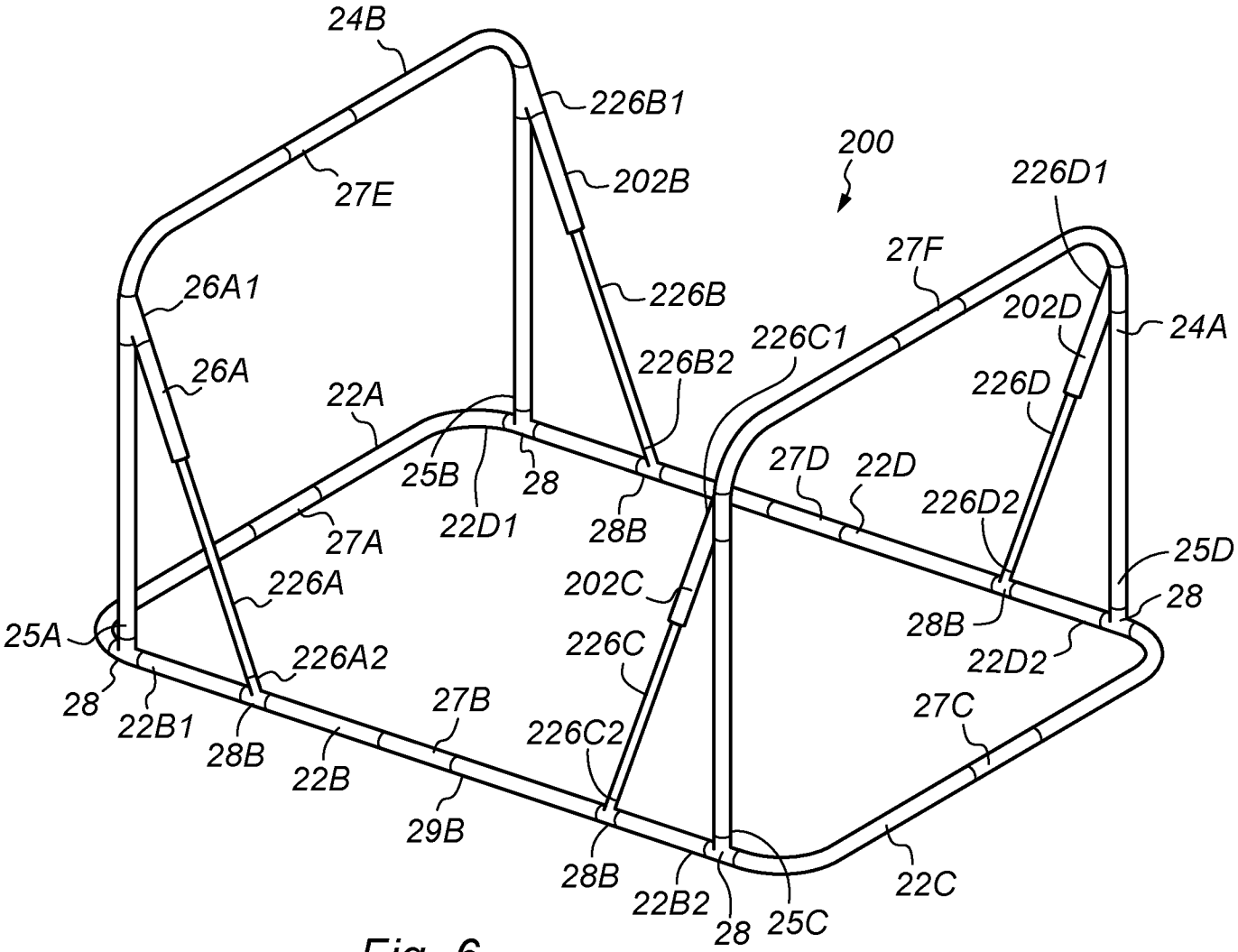
Figure 7:
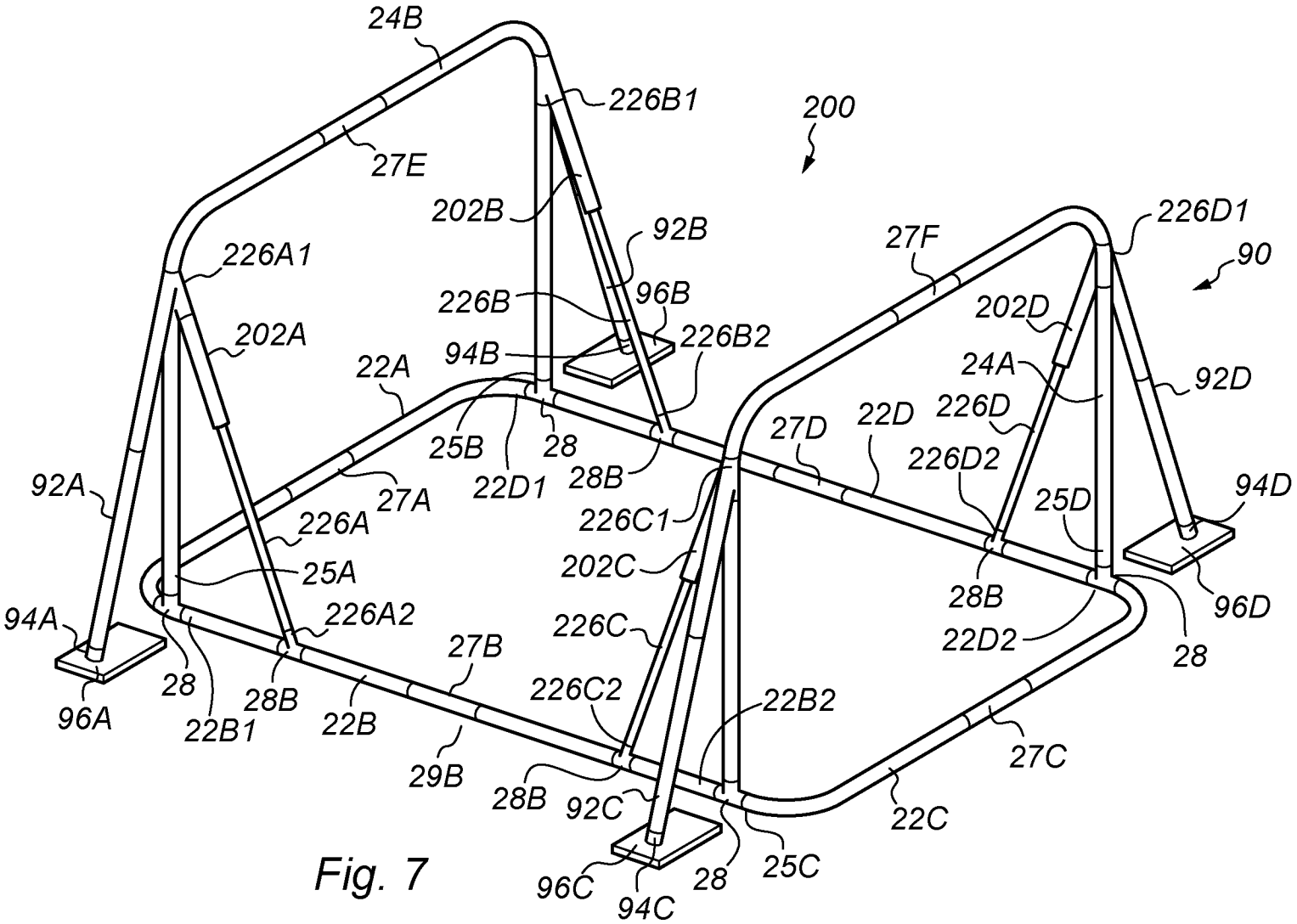

FIG. 6 a frame of a portable confinement apparatus in accordance with a further embodiment of the present invention, and FIG. 7 a frame of a portable confinement apparatus in accordance with a yet further embodiment of the present invention.

In FIGS. 1A, 1B, 1C and 1D there is shown a portable confinement apparatus 10 for confining a child or adult while they are sleeping, resting or playing. The apparatus 10 is formed of a frame 20 and an enclosure 30. The frame 20 is formed of elongate resilient members, in this case poles, arranged to form a planar base 22 and a bridge support 24. Enclosure 30 is formed of a flexible resilient material which in part will be breathable such as a mesh, and may in part be opaque. The enclosure 30 is provided with a base 32, side walls 34 and a roof 36 within which is defined a confinement void 50. The base 32 is provided with a pocket 40 which is adaptable to receive a mattress (not shown) and frame attachment sections 42. The upper surface of pocket 40 forms the enclosure base face 38 and the lower surface of pocket 40 forms the floor surface face 39. Padding 21 is arranged to envelope each of the upright sections of bridge supports 24 of the frame 20 and can be secured in position using suitable means such as frame pad covers, or secured under material with zips or any other suitable stabilising strap arrangement (not shown).

Figure 1A:
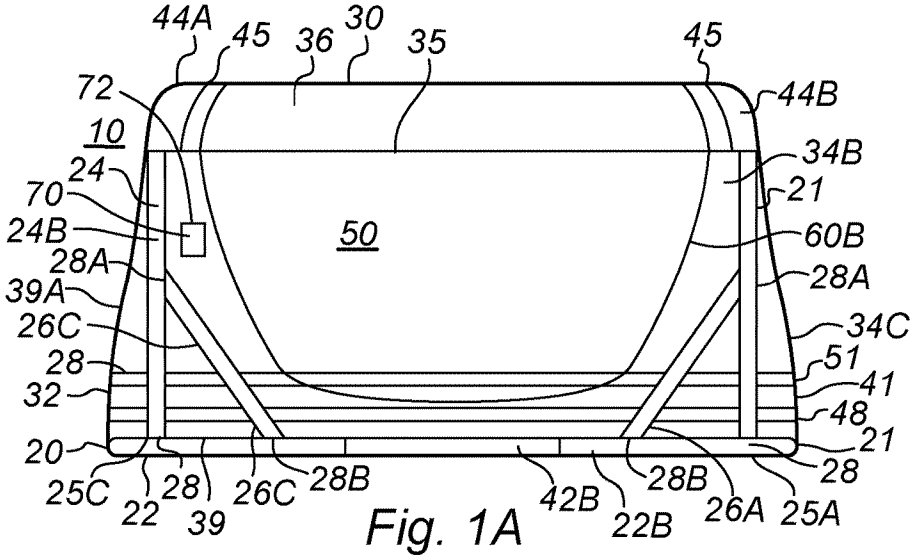
FIG. 1A shows a front view of a portable confinement apparatus in accordance with an embodiment of the present invention.
Figure 1B:
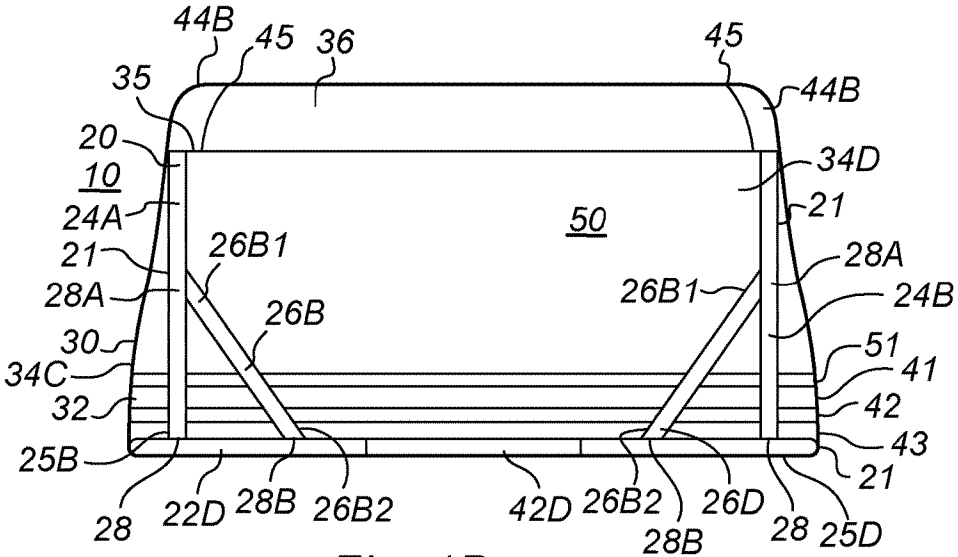
FIG. 1B shows a back view of a portable confinement apparatus in accordance with an embodiment of the present invention.
Figure 1C:
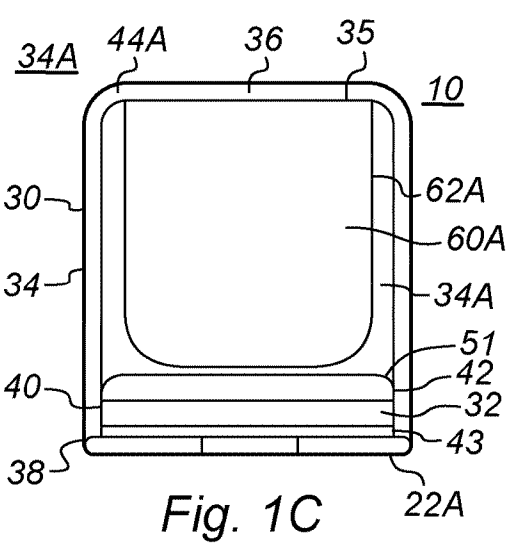
FIG. 1C shows a first end view of a portable confinement apparatus in accordance with an embodiment of the present invention.
Figure 1D:
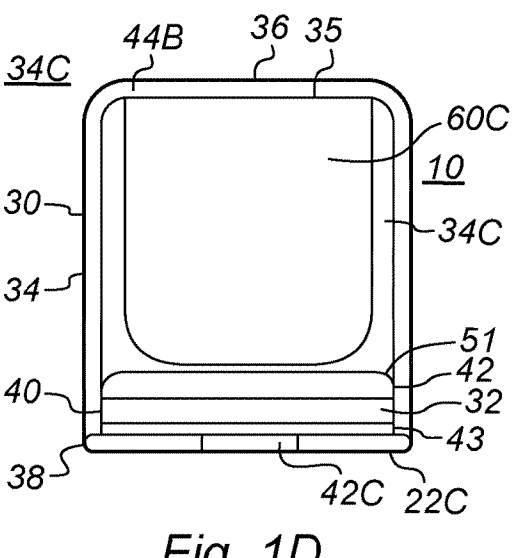
FIG. 1D shows a second end view of a portable confinement apparatus in accordance with an embodiment of the present invention.
Figure 2:
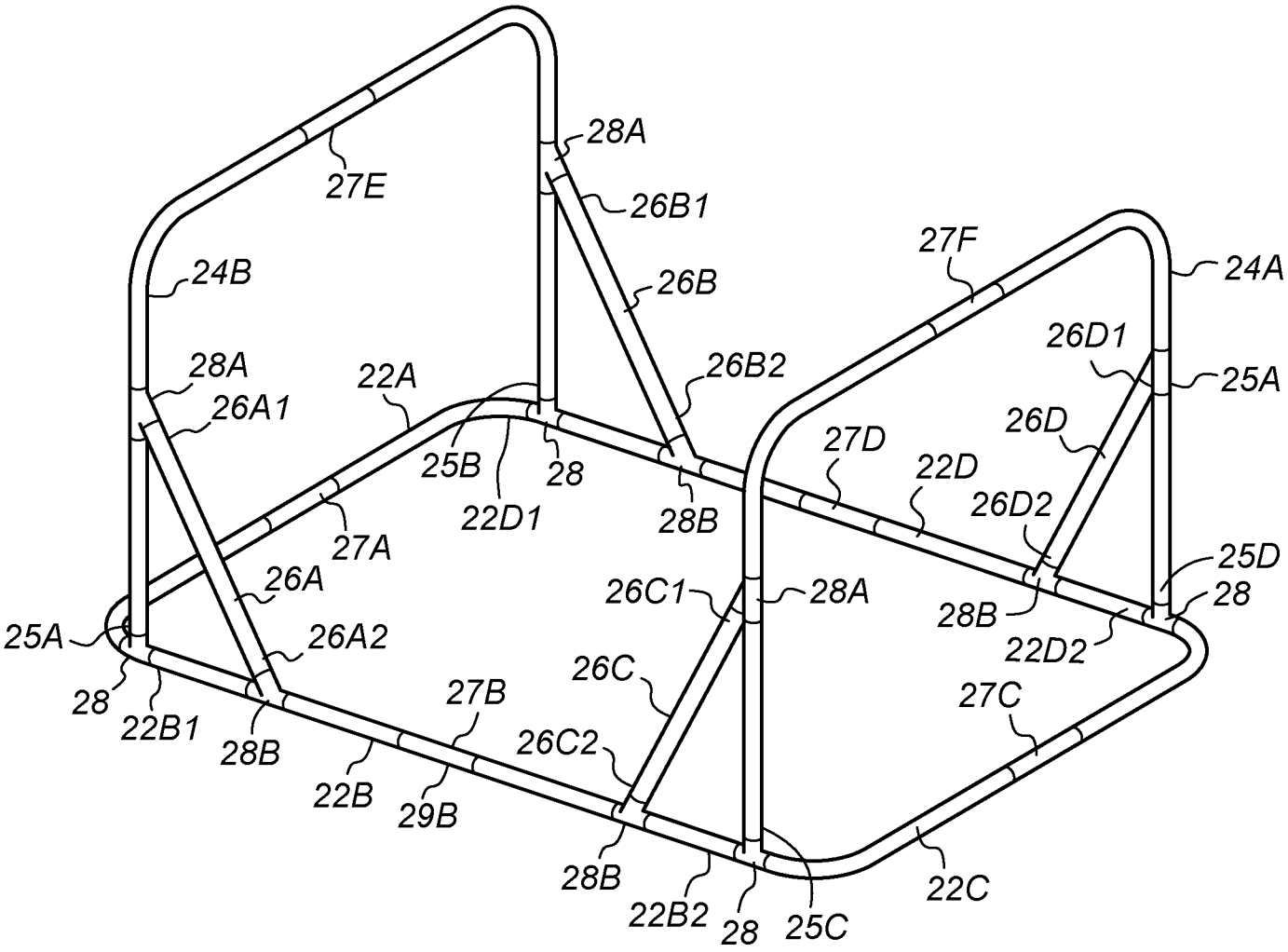
FIG. 2 shows a frame of a portable confinement apparatus in accordance with an embodiment of the present invention.

With reference to FIG. 2, base 22 of the frame 20 is formed of elongate base poles 22B and 22D which lie in parallel with one another and base poles 22A and 22C, which are shorter than base poles 22B, D, and which lie in parallel with one another such that base poles 22A, B, C and D co-operate to substantially define a rectangle. To enable each base pole 22 to be folded to assist in portability of the apparatus 10, each base pole 22A, B, C, D is provided with a centrally located folding mechanism, in this case knuckle joints 27A, B, C and D respectively which are tube knee joints with a spring pin but it will be appreciated that any suitable jaw slide type joint may be suitably used.

Bridge support members 24A and 24B each have a substantially inverted "U" shaped profile with first end 25A of bridge support 24B connected to, and extending perpendicularly from, a first end 22B1 of base pole 22B and extending across the base 22 such that the second end 25B is connected to, and extends perpendicularly from, a first end 22D1 of base pole 22D. Similarly a first end 25C of bridge support 24A is connected to, and extends perpendicularly from, a second end 22B2 of base pole 22B and extends across the base 22 such that the second end 25D is connected to, and extends perpendicularly from, a first end 22D2 of base pole 22D. Thus the bridge supports 24A and 24B are arranged in parallel with one another. Each connection between bridge supports 24A, B and base poles 22B, D is a pivot type connection, in this case a jaw slide with spring pin and wire 28, to facilitate the folding of the frame and assist in the portability of the apparatus 10. Each bridge support member 24A, B is also provided with a centrally located folding mechanism, in this case knuckle joints 27E and 27F respectively which are tube knee joints with a spring pin but it will be appreciated that any suitable jaw slide type joint may be suitably used.

Four support struts 26A, B, C, D are provided to enhance the strength and robustness of the frame 20 and are connected at a first end 26A1, 26B1, 26C1, 26D1 to bridge supports 24A, B above ends 25A, 25B, 25C and 25D respectively. Each connection 28A between struts 26A, B, C, D and bridge sections 24A, B is a pivot type connection which in this case is a jaw slide with spring pin and wire.

From the bridge support connections 28A, the support struts 26A, B, C, D are angled diagonally down towards the centre 29B, 29D of base poles 22B, 22D such that second ends 26A2 and 26C2 are connected to base pole 22B and second ends 26B2, 26D2 are connected to base pole 22D. Each connection 28B between 26A, B, C, D and base poles 22B, 22D is a pivot type joint, in this case, a jaw slide with spring pin and wire, to facilitate the folding of the frame to assist in portability of the apparatus 10.

When apparatus 10 is assembled, base poles 22A, B, C, D are secured to enclosure 30 by a frame attachment section 42A, B, C, D provided at the base 32 of the enclosure. The floor surface face 39 is arranged such that it conforms to the extent of the base frame 22, the dimensions of which can be selected to conform to a predetermined mattress size.

The pocket 40 extends up from the floor surface face 39 and is provided with an opening and closing mechanism, in this case a first zipper 41, which allows for a mattress (not shown) to be inserted into and removed from the pocket 40. The first zipper 41 extends around the entire perimeter of the pocket 40 enabling the base surface 38, sides 34 and roof 36 of the enclosure to be removed entirely from the floor surface face 39 for the purposes of washing the enclosure or for ease of inserting and removing the mattress (not shown).

Arranging a mattress within pocket 40, below the base face 38 of the enclosure 10, provides a person with a comfortable base on which to lie upon when within void 50. The pocket 40 is further provided with a second zipper 43, otherwise known as a collapsible zipper or a concertina zipper, which allows for the upwards extend of the pocket 40 to be adjusted thus enabling mattresses with different heights to be used in the apparatus 10 whilst ensuring the mattress fits snugly within the pocket 40 thus removing strain on the pocket fabric, stress on any seams which may form the pocket, or the ability of the mattress to move freely within the pocket. By confining the mattress snugly within the pocket 40, the stability of the apparatus 10 is significantly enhanced.

The upper surface of the pocket 40 forms base face 38 of the enclosure and side walls 34A, B, C, D extend upwards from the base face 38 to the roof 36. As the side walls of the enclosure conform closely to the shape of the frame structure 30, the side walls rise substantially vertically from the base face 38 to the roof 36. The substantially vertical side walls 34 means that the flexible material of the enclosure will not impinge upon the head space of a person lying on the mattress (not shown) within the pocket 40 of the apparatus 10.

Frame attachment sections 44A and 44B are provided at opposing ends of the roof 36 and bridging members 24A and 24B respectively are slotted through the frame attachment sections 44A, B thus securing the bridge members 24A, B integrally within the fabric of the enclosure 30. The frame attachment sections 44A, B are arranged such that, along with the padding 21 and frame attachment sections 42A, B, C, D which secure the enclosure 30 to the base frame 22, the frame 30 is held securely and robustly in a manner which prevents slippage of the enclosure fabric along the bridge members 24A, B. Frame attachment sections 44A, 44B are provided with a zipper opening 45 to allow the bridge members 24A, B to be securely located within the frame attachment sections 44A, 44B of the roof 36. It will be appreciated that additional frame attachment sections may be provided on the side walls 34B, D where adjacent to the bridge supports 24A, B thus further impeding the ability of the enclosure fabric to slip along the bridge supports 24A, B and therefore increasing the stability of the apparatus 10. It will be appreciated that any of the frame attachment sections can be secured by zips, straps and/or buckles.

The enclosure 30 is further provided with three closable openings 60A, 60B and 60C. Each closable opening is, in this case, a zip fastening flap. Flap 60A is formed in side wall 34A, flap 60B is formed in adjacent side wall 34B, and flap 60C is formed in side wall 34C providing easy access to the void for one carer, or two carers working together, for assisting in the maneuvering of a person (not shown) located within the void 50. As the bridge supports 24A, B are disposed at the ends of base poles 22B, D, the area of side wall surface available for a flap opening 60 is maximized. Each flap 60A, B, C is of the dimension that accounts for the majority of the surface of wall 34A, B, C respectively, thus enabling the flaps to be opened to the extent that an adult may easily access the void 50 within the enclosure 30. Flaps 60A and 60C extend across the extent of side walls 34A, 34C to the extent of roof line 35. The flap 60B extends beyond the side walls 34B into a small portion of the roof 36 such that, when fully opening, each of flaps 60A, 60B can be folded back sufficiently to allow a limited amount of vertical access, or access from above the enclosure 30, into the void 50.

In addition to access flaps 60, an additional closable access hole 70 is provided in the enclosure 30, in this case shown on side wall 34B, providing access for equipment or monitors. The patch 72 is secured by a zipper but it will be understood that any suitable secure fastening mechanism may be used. Interchangeable patches (not shown) can be provided to cover the access hole 70 such that access holes for things such as IV tubing or a patch for a webcam to see inside for seizure alert can be provided.

The base face 38 of the void 50 can further be provided with a zipped-in bedsheet 51 which can be removed from the void 50 for washing thus saving the disassembly of the entire enclosure 30 for the purposes of cleaning. The zipped-in bedsheet 51 eliminates the risk of an occupant of the void 50 becoming entrapped during a seizure or a period of high night-time mobility.

In use, the portable containment apparatus 10 provides a safe, fully enclosed void 50 which is suitable for daily or night-time use and the apparatus 10 is what is termed a "6 in 1" system meaning it is suitable for home, play, respite/hospital, travel, school and transitional. The apparatus 10 provides a low sensory environment so can be used during the day to help an individual become de-stimulated or it can be used at night to prevent night-time wandering or entrapment during a seizure or high night-time mobility. With bridge supports of frame 24A, B provided with padding, the ability of an individual to hurt themselves when within the apparatus is limited should they have self-injurious behaviour. The base frame 22 is planar meaning the apparatus can be used on surfaces including, but not limited to, the floor, on a divan base or bed frame or on a profile bed. The provision of folding joints 27 and 28 in the frame 20 means the apparatus 10 can fold neatly into a small volume and thus is suitable for transportation and storage in a container such as a wheeled suitcase.

In one embodiment, the zipper fastenings can be arranged such that they are accessible from the outside only to prevent the individual inside from reaching the zip and potentially sliding it down. This is achieved by providing a webbed backing to the zips on the closable openings. A plastic buckle (not shown) may further be used to attach the top of the zipper to enclosure to further impede the zipper being operated from within the void. Furthermore, zippers provided with a locking head mechanism (not shown) can be used to prevent unintentional slippage of the zipper.

In an alternative embodiment, reversible-headed or double-headed zippers may be used to allow access from the inside or outside. Reversible-headed zippers can be suitable so if a person using the apparatus 10 has danger awareness but high night-time mobility or seizures meaning they can close the zip to protect themselves whilst they sleep but can still get out to go to the toilet, or to get up in the morning.

It will be appreciated that if the apparatus 10 is to be adjusted for use with a double or single mattress, additional frame poles can be incorporated into the frame 20 at each joint 27 making the frame easily adaptable whilst minimizing the manufacturing burden by reducing components.

Figure 3:
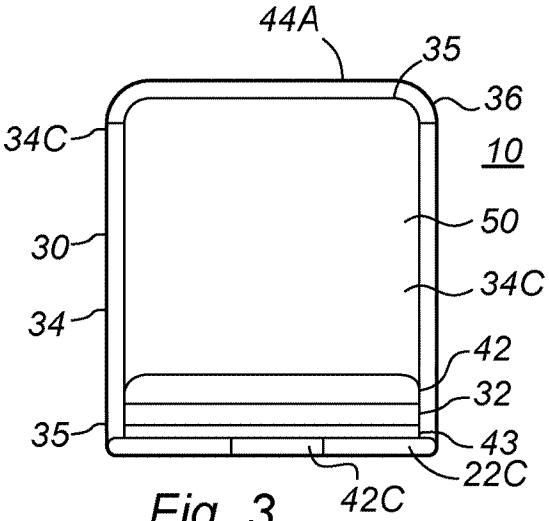
FIG. 3 shows a second end view of a portable confinement apparatus in accordance with another embodiment of the present invention.

It will also be appreciated that whilst three openings 60A, 60B and 60C have been detailed, the enclosure may only be provided with two openings such that end wall 34C is provide as a side wall only and without an opening such as is shown in FIG. 3. In this arrangement, the two opening flaps 60A and 60B are located in adjacent walls allowing for access to the void 50 by two carers working at right angles to one another.

It will be appreciated that the two opening flaps could alternatively be located in opposing walls, allowing for "straight-through" access to the enclosure void 50 thus facilitating the ability to move and handle a person disposed in the enclosure void when using a stretcher or the like (not shown).

It will be understood that, alternatively, more than two or three openings may be provided with the option of providing an opening in each wall giving universal access to the void 50.

Figure 4:
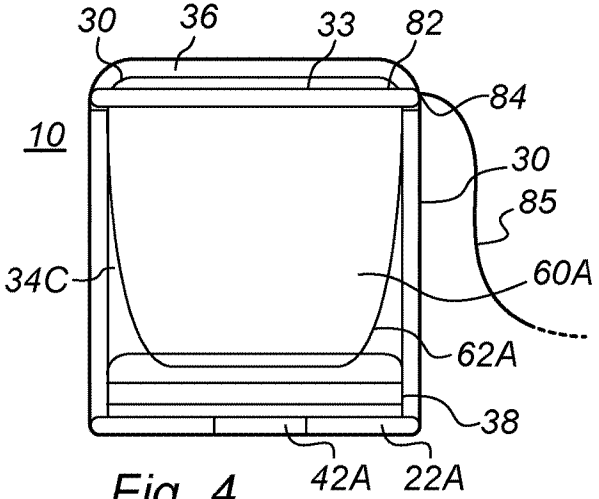
FIG. 4 shows an internal end view of a portable confinement apparatus in accordance with an embodiment of the present invention.

With reference to FIG. 4 there is shown side wall 34A from within the void 50. The wall 34A is provided with a flap 60A and above the flap 60A, at the point where the roof 36 meets the side wall 34A, there is arranged an illumination arrangement, in this case a strip of light emitting diodes (LEDs). The LEDs can be operated from outside the enclosure 30 and allow the void 50 to be illuminated when it is dark or visibility is low. The LEDs will enhance the utility of the apparatus 10 by illuminating the void 50 which will help with personal care of an occupant or when changing the zipped-in bedsheet in a darkened room. The strip of LED lights is housed within a sheer sheath 82 arranged along roof line 35

The sheath 82 exits the enclosure 30 on either side through a grommit 86 and the LED strip can be connected, via connector 85, to a power source external to the enclosure (not shown). The LED lights can be removed from the sheath 82 for the purpose of washing the enclosure 30.

Figure 5:
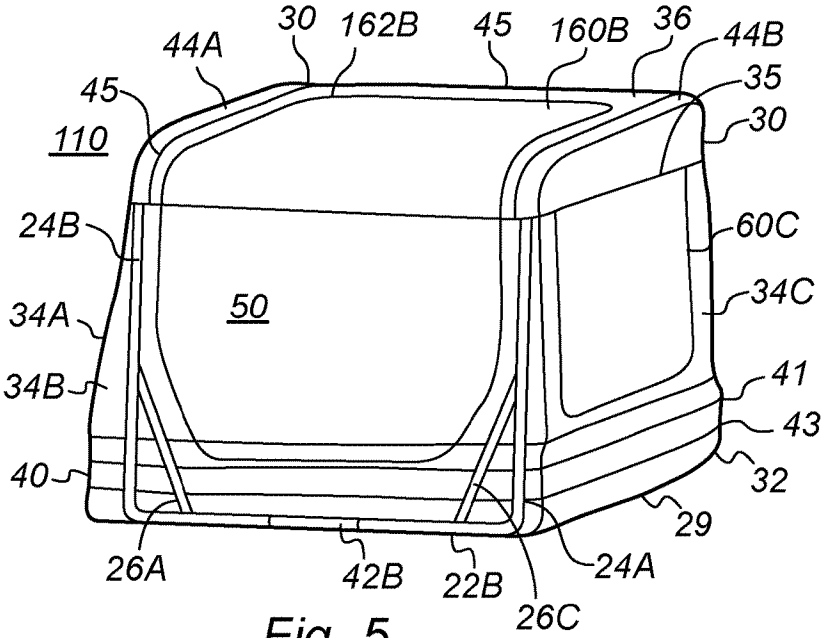
FIG. 5 shows a perspective front view of a portable confinement apparatus in accordance with an embodiment of the present invention.

With reference to FIG. 5 there is shown an embodiment of the apparatus 110 with reference numerals of FIG. 1 used for like components. The enclosure 30 is in this case provided with three openings, opening 60A (not shown), opening 160B and opening 160C. As can be seen, opening 160B extends across the majority of the surface area of side wall 34B and up across the majority of the surface area of the roof 36 of the enclosure 30. Openings 60A (not shown) and 60C only extend across the side walls 34A, 34C respectively to extend of the roof line 35. By having an extended opening version of flap 160B, the flaps 160B can open the side wall 34B and across into the roof 36, providing increased access to the void 50. The increased access to the void 50 through the roof 36 can assist in the use of hoist equipment (not shown) and other apparatus such as stretcher equipment (not shown) which may be necessary in the moving and handling of those located within the enclosure 30.

Furthermore, whilst the flap 160B has been described as opening back across the majority of the roof 36, a single flap which extends across the roof 36 and down opposing side 34D may be used to further facilitate vertical access to the void 50.

Referring now to FIG. 6 there is shown an alternative embodiment of a frame 200, with reference numerals of the frame 20 of FIG. 2 used for like components. With reference to FIG. 6, base 22 and bridge support members 24A, 24B are as for the frame 20. The bridge supports 24A, 24B may be formed in sections so as to telescopically extend. Sprung pins may hold them in the extended position or other fixing means known to those skilled in the art can be used. In this way, the bridge supports 24A, B can be collapsed to provide metal frame poles of a shorter length for packing when the frame 200 is disassembled for transport or storage.

Frame 200 has an alternative arrangement of support struts 226A, B, C, D. Support struts 226A, B, C, D now include a piston 202A, B, C, D at the first ends 226A1, 226B1, 226C1, 226D1 respectively. Each piston is a cushioned piston to allow telescopic collapsing of the strut 226A, B, C, D if force is applied along the strut. Each piston is preferably a pneumatic gas strut as these are available with outer cylindrical dimensions to match the frame poles. The connections at 28 are now pivoted between the ends 25A, 25B, 25C and 25D of the bridge supports 24A, B and the base 22, while the joints 28B between the ends 226A2, 226B2, 226C2, 226D2 of the struts 226A, B, C, D and the base 22 are also of the pivot type. Additionally, the struts 226A, B, C, D are now longer with the connection to the base being at the same position 28, to allow access through the enclosure, while the upper ends 226A1, 226B1, 226C1, 226D1 are now positioned close to the corners of the bridge supports 24A, B.

In this case, if a user grips a bridge support, say 24A, at the top around the joint 27F and pulls the bridge support 24A inwards towards the base 22, the bridge support 24A will cause compression of the respective pistons 202C, D to allow movement of the bridge support 24A and support struts 226C, D to prevent buckling of the frame 200. This provides added stability and robustness to the apparatus 10.

Referring now to FIG. 7 there is shown optional additional features to the frame 200 of FIG. 6. While the frame 200 of FIG. 6 is illustrated, any embodiment of a frame herein disclosed could be used in combination with the additional features now presented. The additional features in FIG. 7 comprise a stabilisation system, generally indicated by reference numeral 90. Stabilisation system 90 comprises four stabilisation struts 92A-D arranged to splay outwards from the frame 200 and thereby provide additional support and prevent the frame 200 from tipping when the apparatus 10 is pulled in heavy usage.

Stabilisation struts 92A-D are shown connected at the upper ends 226A1, 226B1, 226C1, 226D1, respectively, positioned close to the corners of the bridge supports 24A, B. Stabilisation struts 92A-D are aluminium metal legs, affixing to the bridge supports 24A, B with swivel head pins or any other suitable connection, 90 degrees to the jaw slide for the diagonal support struts 226A, 226B, 226C, 226D. In this way, the stabilisation system 90 does not obstruct access to the openings 60A, B, C of the enclosure 30 and can be easily assembled with the frame 200.

The ends 94A-D of the stabilisation struts 92A-D are located in base plates 96A-D, respectively. The ends 94A-D may be arranged so as to pivot in the base plates 96A-D as desired to set the angle with respect to the frame 200 on construction. Alternatively they may be held at a fixed angle calculated to provide optimum stability to the apparatus 10. Base plates 96A-D are formed of moulded plastic and may be considered as 'feet' providing sufficient surface area with which to spread the load and prevent tipping. Advantageously, the base plates 96A-D have a non-slip coating or alternative gripping means on an underside to prevent slippage on a floor.

Like the other struts of the frame 200, the stabilisation struts 92A-D may be telescopic. This allows adjustment of the length so that they can be shortened for storage and transportation in a suitcase, for example. Telescopic struts also allow the stabilisation system 90 to be adapted to allow the apparatus to be used both directly on a floor, as shown in FIG. 7, or on a raised surface such as a bed. In the case of placement of the apparatus 10 on a raised surface or platform, the stabilisation struts 92A-D could be extended to floor level to provide the required stabilisation. If the raised surface or bed is against a wall, or indeed if the apparatus 10 is located on the floor against a wall, only two stabilisation struts 92A, 92C of the stabilisation system 90 may be needed to provide sufficient stabilisation.

An alternative stabilisation system includes additional stabilisation poles or plates. A stabilisation pole would be arranged parallel to and set out from one or both of the base poles 22A, 22C. These stabilisation poles are connected to the base poles by plastic fittings or by additional poles. The stabilisation poles extend the foot print of the apparatus 10 and prevent tipping. Instead of poles, rigid base plates could be attached to the base poles 22A, 22B which would also prevent tipping by extending the footprint of the apparatus.

The principle advantage of the invention is the provision of a portable confinement apparatus which is stable, robust and easy to access.

A further advantage of the invention is that the portable confinement apparatus can be provided with any suitable thickness of mattress whilst still ensuring stability of the apparatus and comfort for the user.

It will be appreciated to those skilled in the art that various modifications may be made to the invention herein described without departing from the scope thereof. For example, although the elongate members which form frame 30 have been described as poles, it will be appreciated that these may be plastic or metal poles, or may be formed of highly pressurised elongate inflatable members. The apparatus 10 can also be attached to a bed base or frame by stabilising straps made of webbing and/or buckles to secure the frame 22 to the bed base or frame. It will be appreciated that any suitable mattress, including an air mattress or a standard mattress can be used with the apparatus. Any suitable range of flexible material may be used to form the enclosure including, in some parts use of a mesh fabric. The mesh may be selected to have a softer side for the inside of the canopy to reduce the risk of chaffing.

We claim:

1. A portable confinement apparatus for confining a person upon a mattress, the apparatus comprising an enclosure formed of a flexible material adapted to receive a mattress, the enclosure having a base face, at least four side faces and a roof which define a void, and a frame formed of elongate resilient members, the frame having four base members arranged to define a rectangle, two bridge members, arranged entirely parallel to one another at a pre-determined distance, each bridge member having a first end and a second end such that each first end is directly attached at right angles to a first base member and each second end is directly attached at right angles to a second base member, the first base member and the second base member being arranged parallel to each other, and the first and second ends being perpendicular to the first and second base members, wherein, at least part of each base member is integrally secured to the base face and at least part of each bridge member is integrally secured to the roof as the base members and bridge members are slotted through frame attachment sections formed on the outside of the enclosure, the frame includes four support struts, with each support strut being used to brace an end of each bridge member directly to a base member, the enclosure is provided with at least two closable openings with a first closable opening formed on a first side and a second closable opening formed on a second side.

2. A portable confinement apparatus according to claim 1 wherein the first closable opening is formed on a first side and the second closable opening is formed on a second side adjacent to the first side.

3. A portable confinement apparatus according to claim 1 wherein the first closable opening is formed on a first side and the second closable opening formed on a second side opposite to the first side.

4. A portable confinement apparatus according to claim 2 wherein the enclosure is provided with a third closable opening formed on a third side.

5. A portable confinement apparatus according to claim 1 wherein the first closable opening is adapted to extend from the first side to at least a part of the roof.

6. A portable confinement apparatus according to claim 5 wherein the first closable opening is adapted to extend from the first side to a majority of the roof.

7. A portable confinement apparatus according to claim 1 wherein the sides of the enclosure are substantially vertical.

8. A portable confinement apparatus according to claim 1 wherein the enclosure is provided with a closable pocket disposed adjacent the base face, wherein the pocket is adapted to receive a mattress.

9. A portable confinement apparatus according to claim 8 wherein the pocket is provided with a first zipper to enable closable opening of the pocket to receive the mattress.

10. A portable confinement apparatus according to claim 1 wherein one or more of the resilient members are telescopic.

11. A portable confinement apparatus for confining a person upon a mattress, the apparatus comprising an enclosure formed of a flexible material adapted to receive a mattress, the enclosure having a base face, at least four side faces and a roof which define a void, and a frame formed of elongate resilient members, the frame having at least two base members arranged parallel to one another at a pre-determined distance, at least two bridge members, arranged parallel to one another at a pre-determined distance, each bridge member having a first end and a second end such that each first end is coupled to a first base member and each second end is coupled to a second base member, wherein, at least part of each base member is integrally secured to the base face and at least part of each bridge member is integrally secured to the roof as the base members and bridge members are slotted through frame attachment sections formed on the outside of the enclosure, the enclosure is provided with at least two closable openings with a first closable opening formed on a first side and a second closable opening formed on a second side, and wherein the frame includes one or more support struts, each support strut being used to brace a bridge member to a base member, there are two support struts for each bridge member and the support struts include a piston.

12. A portable confinement apparatus according to claim 11 wherein the support struts include pneumatic gas pistons giving telescopic movement and automatic resetting of the support struts back to their original length after controlled collapsing of the support struts by leverage applied to the bridge members.

13. A portable confinement apparatus for confining a person upon a mattress, the apparatus comprising an enclosure formed of a flexible material adapted to receive a mattress, the enclosure having a base face, at least four side faces and a roof which define a void, and a frame formed of elongate resilient members, the frame having at least two base members arranged parallel to one another at a pre-determined distance, at least two bridge members, arranged parallel to one another at a pre-determined distance, each bridge member having a first end and a second end such that each first end is coupled to a first base member and each second end is coupled to a second base member, wherein, at least part of each base member is integrally secured to the base face and at least part of each bridge member is integrally secured to the roof as the base members and bridge members are slotted through frame attachment sections formed on the outside of the enclosure, the enclosure is provided with at least two closable openings with a first closable opening formed on a first side and a second closable opening formed on a second side, and wherein the apparatus further includes a stabilisation system to increase a footprint of the frame.

14. A portable confinement apparatus according to claim 13 wherein the stabilisation system comprises one or more stabilisation struts which are connected to and located outside the frame.

15. A portable confinement apparatus according to claim 14 wherein the stabilisation system includes one or more base plates which are arranged to lie parallel to and outside the frame.

* * * * *